US009805604B2

(12) United States Patent
Mizuguchi

(10) Patent No.: US 9,805,604 B2
(45) Date of Patent: Oct. 31, 2017

(54) TERMINAL DEVICE

(71) Applicant: Panasonic Intellectual Property Management Co., Ltd., Osaka (JP)

(72) Inventor: Takao Mizuguchi, Aichi (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 44 days.

(21) Appl. No.: 14/937,872

(22) Filed: Nov. 11, 2015

(65) Prior Publication Data

US 2016/0148505 A1 May 26, 2016

(30) Foreign Application Priority Data

Nov. 20, 2014 (JP) ..... 2014-235742

(51) Int. Cl.

| | |
|---|---|
| ***G08G 1/056*** | (2006.01) |
| ***G08G 1/01*** | (2006.01) |
| ***G08G 1/16*** | (2006.01) |
| ***G08G 1/09*** | (2006.01) |
| ***G08G 1/0967*** | (2006.01) |

(52) U.S. Cl.

CPC ..... *G08G 1/162* (2013.01); *G08G 1/093* (2013.01); *G08G 1/096716* (2013.01); *G08G 1/096758* (2013.01); *G08G 1/096775* (2013.01); *G08G 1/163* (2013.01)

(58) Field of Classification Search

CPC ..... G08G 1/162; G08G 1/093; G08G 1/163; G08G 1/096758; G08G 1/096775; G08G 1/096716; G08G 1/096861; B60W 30/12; G06F 17/00

USPC ..... 701/41, 300–302, 400, 450

See application file for complete search history.

(56) References Cited

U.S. PATENT DOCUMENTS

2015/0192420 A1* 7/2015 Watters ..... G01C 21/34 701/410

FOREIGN PATENT DOCUMENTS

| | | |
|---|---|---|
| JP | 10-281776 | 10/1998 |
| JP | 2006-004217 | 1/2006 |
| JP | 2007-216739 | 8/2007 |

(Continued)

*Primary Examiner* — Nga X Nguyen

(74) *Attorney, Agent, or Firm* — McDermott Will & Emery LLP

(57) ABSTRACT

A terminal device is disclosed that is mountable in a vehicle. The terminal device comprises an acquirer, storage and a controller. The acquirer acquires, from the vehicle, i) traveling direction information indicating traveling directions of the vehicle in accordance with movement of the vehicle and ii) winker direction information indicating a winker direction indicated by a direction indicator of the vehicle. The controller i) stores in the storage the traveling direction information indicating a first traveling direction of the traveling directions, the first traveling direction being acquired when the acquirer has acquired the winker direction information, and ii) updates the traveling direction information indicating the first traveling direction with the traveling direction information indicating a second traveling direction, the second traveling direction being acquired after the acquirer has acquired the winker direction information, when the second traveling direction indicates a direction opposite to the winker direction.

8 Claims, 13 Drawing Sheets

(56) References Cited

FOREIGN PATENT DOCUMENTS

| | | |
|---|---|---|
| JP | 2011-016494 | 1/2011 |
| JP | 2012-022671 | 2/2012 |

* cited by examiner

TERMINAL DEVICE

BACKGROUND

1. Technical Field

The present disclosure relates to a communication technique. More specifically, the present disclosure relates to a terminal device that outputs notification based on predetermined information.

2. Description of the Related Art

Vehicle information including position information and the like is wirelessly exchanged among a plurality of vehicles, and a risk of collision is determined on the basis of the vehicle information. In such a system, a driver is alerted so as to stop the start of a right-turn action in order to avoid collision with another vehicle traveling on an oncoming lane when a host vehicle is about to make a right turn at an intersection or the like. The start of a right-turn action of the host vehicle is generally detected on the basis of information such as a traveling direction of the host vehicle and the state of a direction indicator. During a right-turn action, the traveling direction and the like of the host vehicle change over passage of time. Therefore, in order to suppress erroneous determination of a positional relationship with the other vehicle, the traveling direction before the start of the right-turn action is stored, and a situation is determined on the basis of this traveling direction. For example, when the start of a right-turn action of the host vehicle is detected, an area for detection of the other vehicle (area of the oncoming lane) that is set before the start of the right-turn action is continuously used (see, for example, Japanese Unexamined Patent Application Publication No. 2012-22671).

The traveling direction before the start of the right-turn action is stored at a timing at which a right turn is indicated by the direction indicator (hereinafter referred to as "right-winker-ON"). However, the timing of right-winker-ON differs from one driver to another. For example, a driver may turn a right winker on while traveling straight or when entering a right-turn lane. Accordingly, the traveling direction before the start of the right-turn action differs depending on the timing of right-winker-ON.

SUMMARY

One non-limiting and exemplary embodiment provides a technique for improving the accuracy of estimation of a traveling direction before a right turn or a left turn irrespective of a timing of direction indication.

In one general aspect, the techniques disclosed here feature a terminal device that is mountable in a vehicle, including: an acquirer operative to acquire, from the vehicle, i) traveling direction information indicating traveling directions of the vehicle in accordance with movement of the vehicle and ii) winker direction information indicating a winker direction indicated by a direction indicator of the vehicle; a storage; and a controller operative to: store in the storage the traveling direction information indicating a first traveling direction of the traveling directions, the first traveling direction being acquired in a case where the acquirer has acquired the winker direction information; update the traveling direction information indicating the first traveling direction with the traveling direction information indicating a second traveling direction, the second traveling direction being acquired after the acquirer has acquired the winker direction information, in a case where the second traveling direction indicates a direction opposite to the winker direction indicated by the winker direction information; and maintain in the storage the traveling direction information indicating the first traveling direction in a case where the second traveling direction indicates a direction same as the winker direction indicated by the winker direction information.

According to the present disclosure, it is possible to improve the accuracy of estimation of a traveling direction before a right turn or a left turn irrespective of a timing of direction indication.

These general and specific aspects may be implemented using a system, a method, and a computer program, and any combination of systems, methods, and computer programs.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
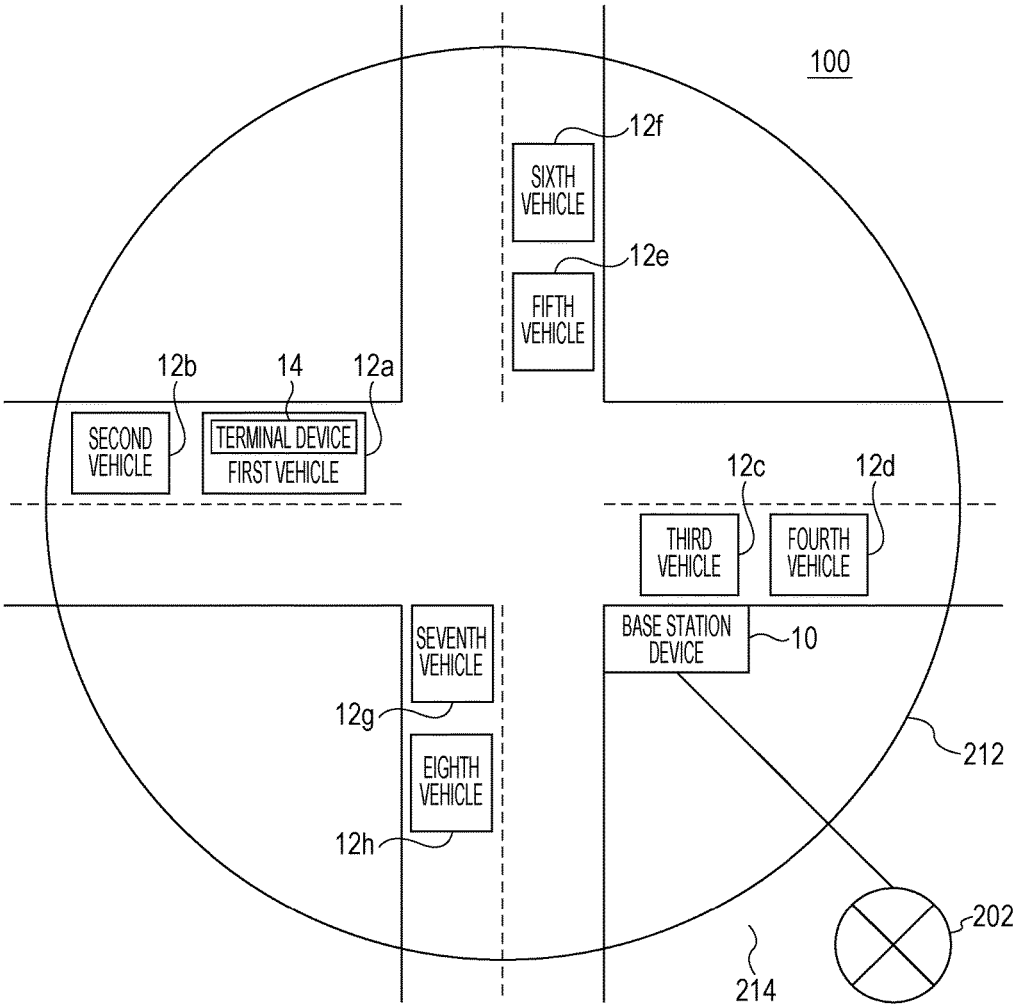
FIG. 1 is a diagram illustrating a configuration of a communication system according to an embodiment of the present disclosure.

Underlying knowledge forming the basis of the present disclosure is described below before a specific embodiment of the present disclosure is described. The embodiment of the present disclosure relates to a communication system in which inter-vehicle communication between terminal devices mounted in vehicles is performed and in which roadside-to-vehicle communication from a base station device provided at an intersection or the like to a terminal device is also performed. Such a communication system is also called ITS (Intelligent Transport Systems). The communication system uses an access control function called CSMA/CA (Carrier Sense Multiple Access with Collision Avoidance) in a similar manner to wireless LAN (Local Area Network) that is compliant with a standard such as IEEE802.11. Therefore, an identical wireless channel is shared by a plurality of terminal devices. Meanwhile, in ITS, it is necessary to transmit information to an indefinitely large number of terminal devices. In order to efficiently perform such transmission, the present communication system broadcasts a packet signal.

That is, a terminal device broadcasts, as inter-vehicle communication, a packet signal in which information such as the position, speed, or traveling direction of a vehicle is stored. Another terminal device receives the packet signal and recognizes the approach or the like of the vehicle on the basis of the information. In order to reduce interference between roadside-to-vehicle communication and inter-vehicle communication, a base station device repeatedly defines a frame including a plurality of sub-frames. The base station device selects, for roadside-to-vehicle communication, any of the plurality of sub-frames, and broadcasts a packet signal in which control information and the like are stored during a period corresponding to the start portion of the selected sub-frame.

The control information includes information concerning a period (hereinafter referred to as a "roadside-to-vehicle communication period") for broadcast transmission of the packet signal by the base station device. A terminal device specifies a roadside-to-vehicle communication period on the basis of the control information and then broadcasts a packet signal by the CSMA method during a period (hereinafter referred to as an "inter-vehicle communication period") other than the roadside-to-vehicle communication period. As a result, the roadside-to-vehicle communication and the inter-vehicle communication are time-division multiplexed. Note that a terminal device that cannot receive the control information from the base station device, i.e., a terminal device that is out of an area formed by the base station device transmits a packet signal by the CSMA method irrespective of the configuration of the frame.

Under such a situation, a terminal device according to the present embodiment derives a support that meets a support occurrence condition on the basis of information included in a packet signal received from another terminal device or a base station device. The present terminal device and a vehicle in which the present terminal device is mounted are collectively referred to as a "host vehicle", and other terminal devices and vehicles in which other terminal devices are mounted are collectively referred to as "other vehicles". The information included in the packet signal is, for example, information on the state of the vehicle transmitted from the other terminal device, information on the state of the vehicle, information on a road shape, or signal information transmitted from the base station device. The "support" refers to a support of driver's driving and is, for example, notification of the presence of another vehicle coming from the opposite direction at a right turn of a host vehicle.

Plural kinds of supports are defined, and a support occurrence condition is defined for each of the supports. Examples of the plural kinds of supports are a right-turn collision prevention support executed by inter-vehicle communication and a crossing collision prevention support executed by inter-vehicle communication. The right-turn collision prevention support is executed in a case where a right winker is on and where a host vehicle and another vehicle is in a positional relationship such that the host vehicle and the other vehicle go by each other. The crossing collision prevention support is executed in a case where a host vehicle and another vehicle is in a positional relationship such that the host vehicle and the other vehicle cross each other. For example, a situation in which another vehicle is coming from ahead of a host vehicle that is traveling corresponds to the positional relationship such that the host vehicle and the other vehicle go by each other. In this situation, the right-turn collision prevention support is executed. In this case, a driver is prompted to pay attention to the oncoming other vehicle when making a right turn. In a case where the host vehicle turns rightward when making a right turn, the positional relationship such that the host vehicle and the other vehicle go by each other changes to the positional relationship such that the host vehicle and the other vehicle cross each other. In this case, the driver is prompted to pay attention to the other vehicle entering from the side. If the contents of alert about the same other vehicle changes in the middle of a right-turn action, there is a risk of driver's confusion.

In order to prevent this, a traveling direction before the start of a right-turn action is stored at a timing at which a right winker is turned on, as described above. The stored traveling direction is used to determine which of the right-turn collision prevention support and the crossing collision prevention support is executed. Therefore, even in a case where the host vehicle turns rightward, the previous positional relationship such that the host vehicle and the other vehicle go by each other is maintained. Accordingly, the right-turn collision prevention support is not changed to the crossing collision prevention support.

However, such processing does not consider a situation in which a traveling direction changes when a host vehicle that is about to make a right turn at an intersection having a right-turn lane enters the right-turn lane from a straight lane. The traveling direction of the host vehicle that is about to enter the right-turn lane swerves to the right once relative to a road direction and is then directed toward the road direction again. For example, in a system in which a timing at which the right winker of the host vehicle is turned on is regarded as the start of a right-turn action, in a case where the right winker is turned on before or after entering the right-turn lane, the traveling direction of the host vehicle is directed toward the road direction. Therefore, in the right-turn collision prevention support, an oncoming vehicle is recognized as an oncoming vehicle. However, in a case where the right winker is turned on at a timing at which the host vehicle changes the traveling direction to the right to enter the right-turn lane, this direction is regarded as the traveling direction. Therefore, the oncoming vehicle is recognized as the other vehicle entering from the side of the host vehicle.

In order to maintain an appropriate traveling direction even if the start of a right-turn action is determined at any timing in a situation in which a host vehicle that is about to make a right turn at an intersection enters a right-turn lane, a terminal device according to the present embodiment stores a traveling direction at a timing at which a right winker is turned on as in the conventional art. Then, the terminal device updates the stored traveling direction in a case where the traveling direction is changed to the left relative to the stored traveling direction. This corresponds to modifying a traveling direction in a case where a traveling direction is stored when a right winker is turned on at a timing at which a host vehicle changes the traveling direction to the right to enter a right-turn lane and then the host vehicle travels along the right-turn lane.

FIG. 1 illustrates a configuration of a communication system 100 according to an embodiment of the present disclosure. FIG. 1 illustrates an intersection viewed from above. The communication system 100 includes a base station device 10; a first vehicle 12*a*, a second vehicle 12*b*, a third vehicle 12*c*, a fourth vehicle 12*d*, a fifth vehicle 12*e*, a sixth vehicle 12*f*, a seventh vehicle 12*g*, and an eighth vehicle 12*h*, which are collectively referred to as vehicles 12; and a network 202. In FIG. 1, only a terminal device 14 mounted in the first vehicle 12*a* is illustrated, but a terminal device 14 is mounted in each of the vehicles 12. Furthermore, an area 212 is formed around the base station device 10, and an outside area 214 is formed outside the area 212.

As illustrated in FIG. 1, a road extending in a horizontal direction, i.e., a left-right direction of FIG. 1 crosses, at a central part, a road extending in a vertical direction, i.e., an top-bottom direction of FIG. 1. In FIG. 1, the top side corresponds to "north", the left side corresponds to "west", the bottom side corresponds to "south", and the right side corresponds to "east". A part at which these two roads cross each other is an "intersection". The first vehicle 12*a* and the second vehicle 12*b* are traveling from left to right, and the third vehicle 12*c* and the fourth vehicle 12*d* are traveling from right to left. The fifth vehicle 12*e* and the sixth vehicle 12*f* are traveling from top to bottom, and the seventh vehicle 12*g* and the eighth vehicle 12*h* are traveling from bottom to top.

In the communication system 100, the base station device 10 is fixedly installed at the intersection. The base station device 10 controls communication between the terminal devices. The base station device 10 repeatedly generates a frame including a plurality of sub-frames on the basis of a signal received from a GPS (Global Positioning System) satellite (not illustrated) or a frame formed by another base station device 10 (not illustrated). It is specified that a roadside-to-vehicle communication period can be set at the start of each of the sub-frames.

The base station device 10 selects a sub-frame in which no roadside-to-vehicle communication period is set by another base station device 10 from the plurality of sub-frames included in the frame. The base station device 10 sets a roadside-to-vehicle communication period at the start of the selected sub-frame. The base station device 10 broadcasts a packet signal during the set roadside-to-vehicle communication period. A plurality of packet signals may be broadcast during the roadside-to-vehicle communication period. The packet signal includes, for example, accident information, traffic jam information, and signal information. Note that the packet signal also includes information concerning a timing at which the roadside-to-vehicle communication period is set and control information concerning the frame.

The terminal device 14 is mounted in each of the vehicles 12 as described above and can therefore be transported. Upon receipt of the packet signal from the base station device 10, the terminal device 14 estimates that the terminal device 14 is within the area 212. In a case where the terminal device 14 is within the area 212, the terminal device 14 generates a frame on the basis of control information included in the packet signal, especially information concerning a timing at which the roadside-to-vehicle communication period is set and information concerning the frame. As a result, the frame generated in each of the plurality of terminal devices 14 is in sync with the frame generated in the base station device 10. The terminal device 14 broadcasts a packet signal during an inter-vehicle communication period that is different from the roadside-to-vehicle communication period. During the inter-vehicle communication period, CSMA/CA is performed. Meanwhile, in a case where the terminal device 14 estimates that the terminal device 14 is within the outside area 214, the terminal device 14 broadcasts a packet signal by performing CSMA/CA irrespective of the configuration of the frame. The terminal device 14 recognizes an approach or the like of a vehicle 12 in which another terminal device 14 is mounted on the basis of a packet signal from the other terminal device 14.

Figure 2:
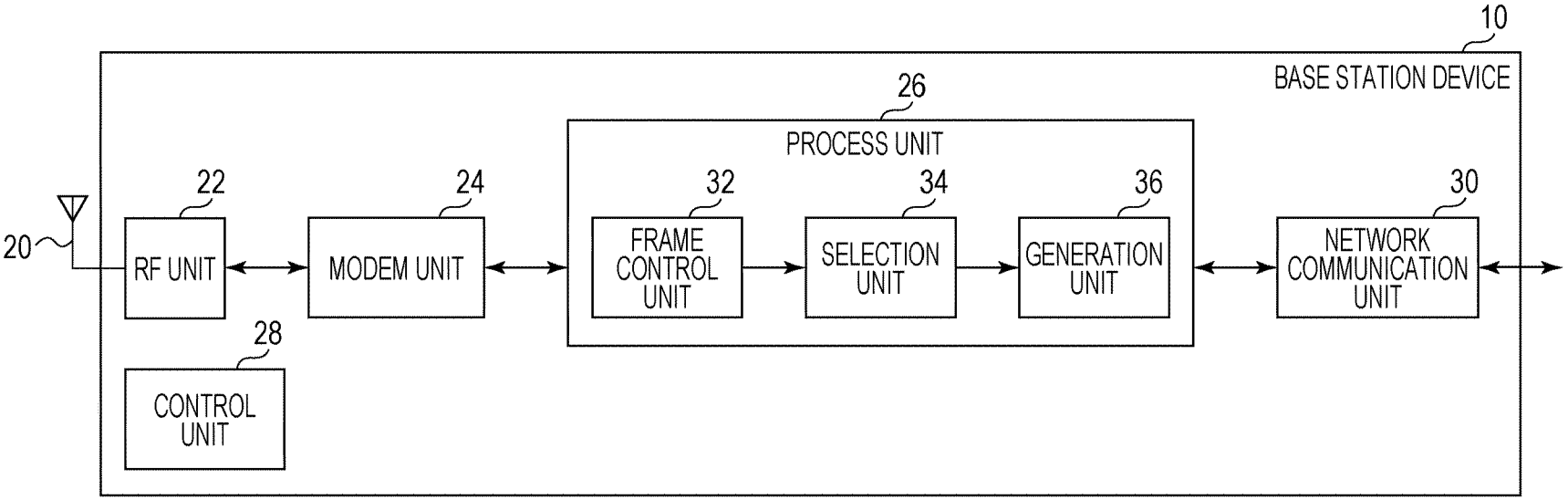
FIG. 2 is a diagram illustrating a configuration of a base station device in FIG. 1.

FIG. 2 illustrates a configuration of the base station device 10. The base station device 10 includes an antenna 20, an RF unit 22, a modem unit 24, a process unit 26, a control unit 28, and a network communication unit 30. The process unit 26 includes a frame control unit 32, a selection unit 34, and a generation unit 36.

The RF unit 22 receives, as a receiving process, a packet signal from a terminal device 14 or another base station device 10 (not illustrated) via the antenna 20. The RF unit 22 converts the frequency of the received wireless frequency packet signal to generate a baseband packet signal. Furthermore, the RF unit 22 supplies the baseband packet signal to the modem unit 24. In general, the baseband packet signal is made up of an in-phase component and an orthogonal component, and therefore two signal lines should be illustrated. However, for clarity in FIG. 2, only one signal line is illustrated. The RF unit 22 includes an LNA (Low Noise Amplifier), a mixer, an AGC, and an ND converter unit.

The RF unit 22 converts, as a transmitting process, the frequency of the baseband packet signal supplied from the modem unit 24 to generate a wireless frequency packet signal. Furthermore, the RF unit 22 transmits the wireless frequency packet signal via the antenna 20 during the roadside-to-vehicle communication period. The RF unit 22 includes a PA (Power Amplifier), a mixer, and a D/A converter unit.

The modem unit 24 demodulates, as a receiving process, the baseband packet signal from the RF unit 22. Furthermore, the modem unit 24 supplies a demodulation result to the process unit 26. Moreover, the modem unit 24 modulates, as a transmitting process, data from the process unit 26. Furthermore, the modem unit 24 supplies, as a baseband packet signal, a modulation result to the RF unit 22. Since the communication system 100 supports an OFDM (Orthogonal Frequency Division Multiplexing) modulation method, the modern unit 24 also performs, as a receiving process, FFT (Fast Fourier Transform) and performs, as a transmitting process, IFFT (Inverse Fast Fourier Transform).

The frame control unit 32 receives a signal from a GPS satellite (not illustrated) and acquires time information on the basis of the received signal. Note that acquisition of the time information can be performed by using a known art, and description thereof is omitted. The frame control unit 32 generates a plurality of frames on the basis of the time information. For example, the frame control unit 32 generates 10 frames of "100 msec" by dividing a period of "1 sec" into 10 sections on the basis of a timing indicated in the time information. By repeating such a process, a frame is repeatedly defined. Note that the frame control unit 32 may detect control information from the demodulation result and generate a frame on the basis of the detected control information. Such a process corresponds to generating a frame that is in sync with a timing of a frame generated by another base station device 10.

Figure 3:
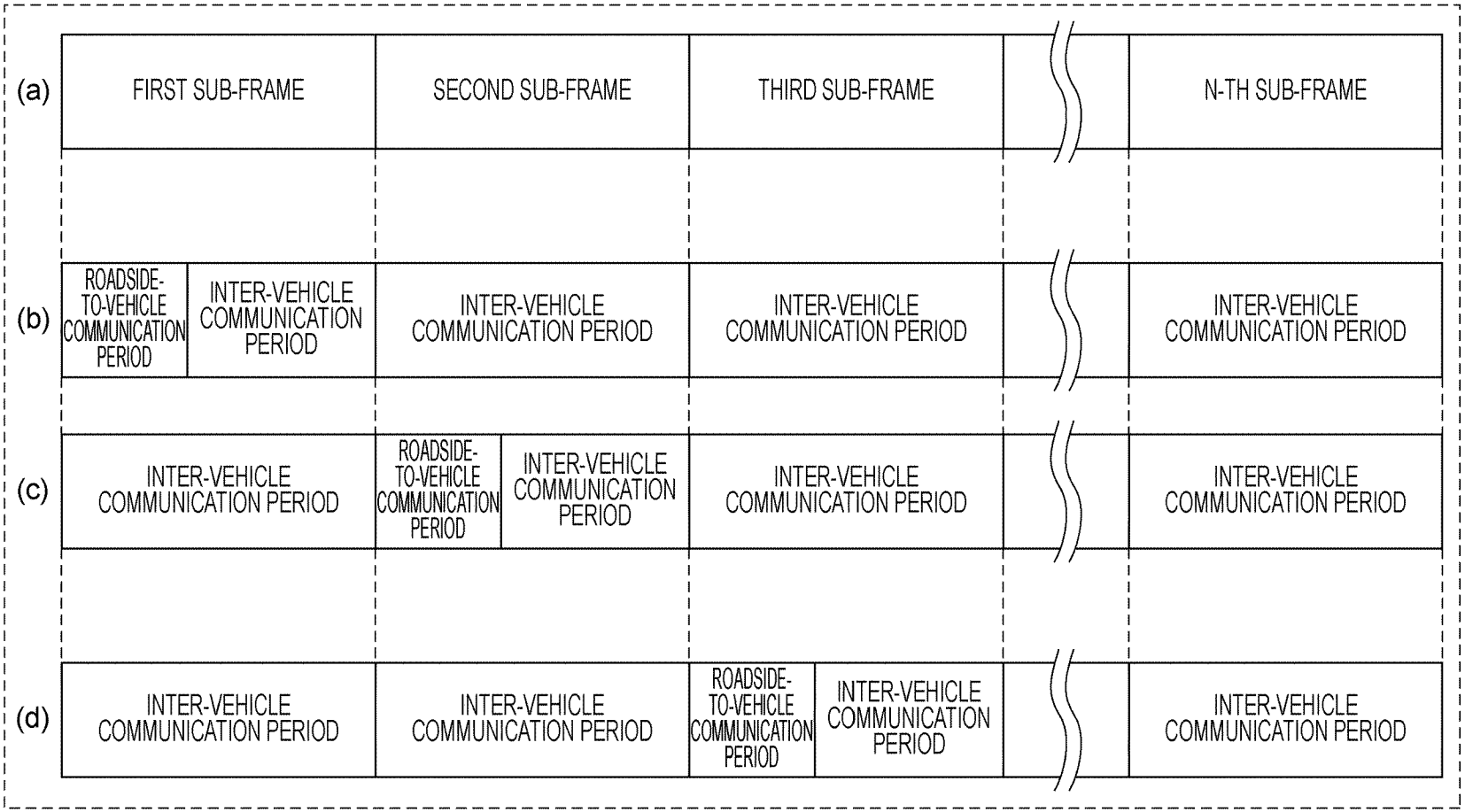
FIG. 3 is a diagram illustrating a format of a frame defined in the communication system in FIG. 1.

FIG. 3 illustrates a format of a frame defined in the communication system 100. FIG. 3(*a*) illustrates a configuration of the frame. The frame is made up of N sub-frames, i.e., the first sub-frame through the N-th sub-frame. That is, it can be said that the frame is formed by time-multiplexing a plurality of sub-frames that can be used for broadcast of a packet signal by the terminal device 14. For example, in a case where the length of the frame is 100 msec and where N is 8, sub-frames each having a length of 12.5 msec are defined. N may be a number other than 8. FIGS. 3(*b*) through 3(*d*) are described later. The following description returns to FIG. 2.

The selection unit 34 selects a sub-frame in which a roadside-to-vehicle communication period should be set from among the plurality of sub-frames included in the frame. Specifically, the selection unit 34 accepts the frame defined by the frame control unit 32. Furthermore, the selection unit 34 accepts an instruction concerning the selected sub-frame via an interface (not illustrated). The selection unit 34 selects a sub-frame corresponding to the instruction. Separately from this, the selection unit 34 may automatically select a sub-frame. In this case, the selection unit 34 receives a demodulation result from another base station device 10 or a terminal device 14 (not illustrated) via the RF unit 22 and the modem unit 24. The selection unit 34 extracts the demodulation result received from another base station device 10. The selection unit 34 specifies a sub-frame for which the demodulation result has not been accepted by specifying a sub-frame for which the demodulation result has been accepted.

This corresponds to specifying a sub-frame in which a roadside-to-vehicle communication period has not been set by another base station device 10, i.e., an unused sub-frame. In a case where there are a plurality of unused sub-frames, the selection unit 34 randomly selects one sub-frame. In a case where there is no unused sub-frame, i.e., in a case where each of the plurality of sub-frames is being used, the selection unit 34 acquires reception electric power corresponding to the demodulation result and preferentially selects a sub-frame of small reception electric power.

FIG. 3(*b*) illustrates a configuration of a frame generated by a first base station device 10*a* (not illustrated). The first base station device 10*a* sets a roadside-to-vehicle communication period at the start of a first sub-frame. Furthermore, the first base station device 10*a* sets an inter-vehicle communication period in a period of the first sub-frame excluding a roadside-to-vehicle communication period and in the second to N-th sub-frames. The inter-vehicle communication period is a period in which the terminal device 14 can broadcast a packet signal. That is, it is specified that the first base station device 10*a* can broadcast a packet signal during the roadside-to-vehicle communication period, which is the start of the first sub-frame, and the terminal device 14 can broadcast a packet signal during an inter-vehicle communication period other than the roadside-to-vehicle communication period in the frame.

FIG. 3(*c*) illustrates a configuration of a frame generated by a second base station device 10*b* (not illustrated). The second base station device 10*b* sets a roadside-to-vehicle communication period at the start of a second sub-frame. Furthermore, the second base station device 10*b* sets an inter-vehicle communication period in a period of the second sub-frame excluding the roadside-to-vehicle communication period, the first sub-frame, and the third sub-frame through the N-th sub-frame. FIG. 3(*d*) illustrates a configuration of a frame generated by a third base station device 10*c* (not illustrated). The third base station device 10*c* sets a roadside-to-vehicle communication period at the start of the third sub-frame. Furthermore, the third base station device 100 sets an inter-vehicle communication period in a period of the third sub-frame excluding the roadside-to-vehicle communication period, the first sub-frame, the second sub-frame, and the fourth sub-frame through the N-th sub-frame. In this way, the plurality of base station devices 10 select different sub-frames and set a roadside-to-vehicle communication period at the start of the selected sub-frames. The following description returns to FIG. 2. The selection unit 34 supplies a number of the selected sub-frame to the generation unit 36.

The generation unit 36 receives the number of the sub-frame from the selection unit 34. The generation unit 36 sets a roadside-to-vehicle communication period in the sub-frame having the received sub-frame number, and generates a packet signal that should be broadcast in the roadside-to-vehicle communication period. In a case where a plurality of packet signals are transmitted during one roadside-to-vehicle communication period, the generation unit 36 generates these packet signals. A packet signal is made up of control information and a payload. The control information includes, for example, a number of a sub-frame in which a roadside-to-vehicle communication period has been set. The payload includes, for example, accident information, traffic jam information, and signal information. These data are acquired from the network 202 (not illustrated) by the network communication unit 30. The process unit 26 causes the modem unit 24 and the RF unit 22 to broadcast a packet signal during the roadside-to-vehicle communication period. The control unit 28 controls the process of the whole base station device 10.

This configuration is realized by a CPU, memory, and other LSI of any computer in the case of hardware and is realized by a program loaded to memory in the case of software. In FIG. 2, functional blocks realized by cooperation of these are illustrated. Therefore, it is understood by a person skilled in the art that these functional blocks are realized in various forms by hardware only or by a combination of hardware and software.

Figure 4:
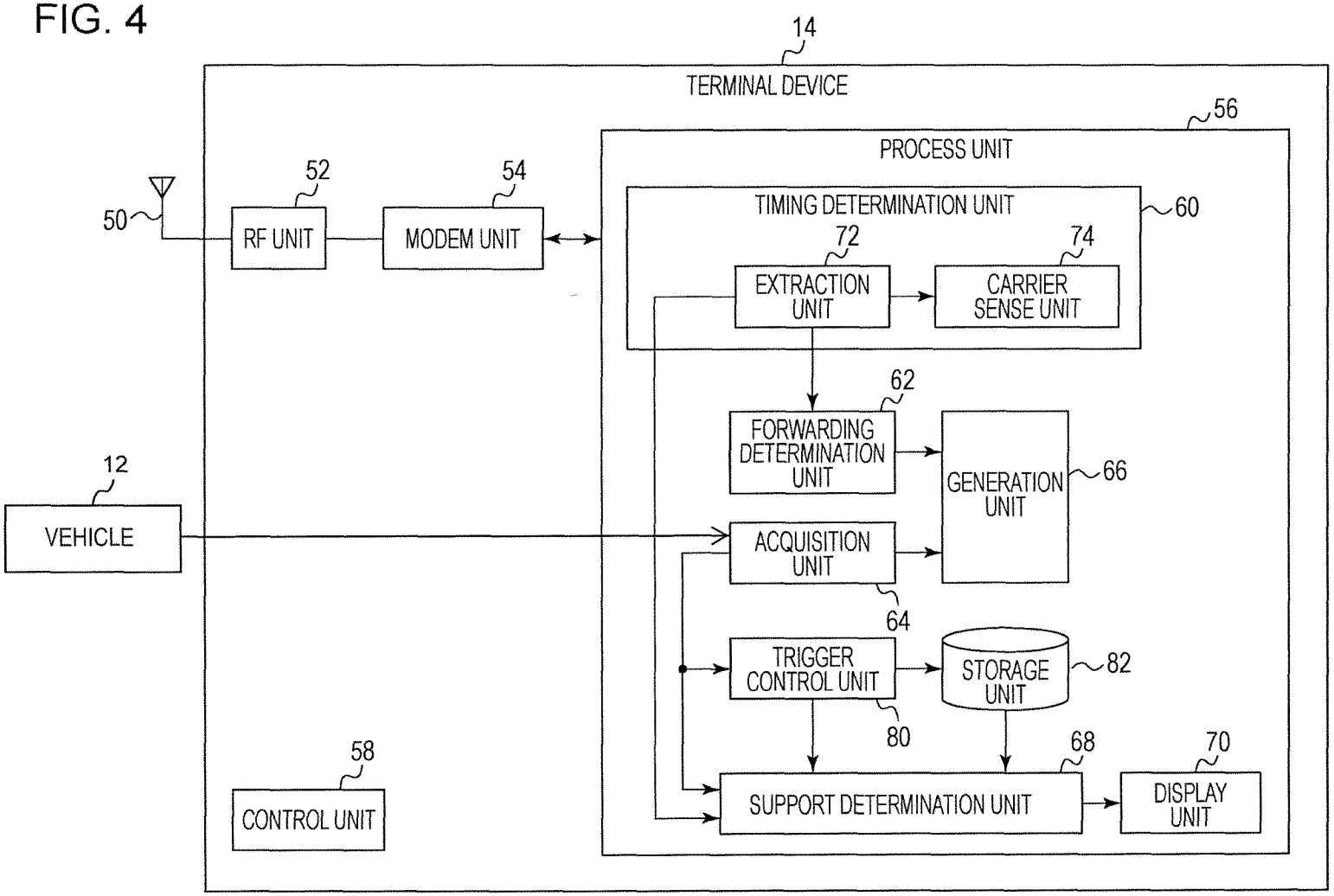
FIG. 4 is a diagram illustrating a configuration of a terminal device in FIG. 1.

FIG. 4 illustrates a configuration of the terminal device 14. The terminal device 14 includes an antenna 50, an RF unit 52, a modern unit 54, a process unit 56, and a control unit 58. The process unit 56 includes a timing determination unit 60, a forwarding determination unit 62, an acquisition unit 64, a generation unit 66, a support determination unit 68, a display unit 70, a trigger control unit 80, and a storage unit 82. The timing determination unit 60 includes an extraction unit 72 and a carrier sense unit 74. The terminal device 14 can be mounted in each of the vehicles 12 as described above. The antenna 50, the RF unit 52, and the modem unit 54 perform similar processes to the antenna 20, the RF unit 22, and the modem unit 24 of FIG. 2. The following discusses mainly differences.

The modem unit 54 and the process unit 56 receive, in a receiving process, a packet signal from another terminal device 14 or the base station device 10 (not illustrated). As described above, the modem unit 54 and the process unit 56 receive a packet signal from the base station device 10 during a roadside-to-vehicle communication period, and receive a packet signal from another terminal device 14 during an inter-vehicle communication period. The packet signal from another terminal device 14 includes at least the current position, traveling direction, traveling speed, and the like (hereinafter referred to as "position information") of another vehicle 12 in which this terminal device 14 is mounted.

In a case where a demodulation result supplied from the modem unit 54 is a packet signal from the base station device 10 (not illustrated), the extraction unit 72 specifies a timing of a sub-frame in which a roadside-to-vehicle communication period is set. In this case, the extraction unit 72 estimates that the terminal device 14 is within the area 212 of FIG. 1. The extraction unit 72 generates a frame on the basis of the timing of the sub-frame and the contents of a message header of the packet signal, specifically, the contents in the roadside-to-vehicle communication period. Note that generation of the frame is performed in the same manner as the frame control unit 32, and description thereof is omitted. As a result, the extraction unit 72 generates a frame that is in sync with the frame generated in the base station device 10. In a case where a source of broadcast of the packet signal is another terminal device 14, the extraction unit 72 omits a process of generating a synchronized frame, but extracts position information included in the packet signal and supplies the extracted position information to the support determination unit 68.

Meanwhile, in a case where the packet signal from the base station device 10 is not received, the extraction unit 72 estimates that the terminal device 14 is within the outside area 214 of FIG. 1. In a case where the extraction unit 72 estimates that the terminal device 14 is within the area 212, the extraction unit 72 selects an inter-vehicle communication period. In a case where the extraction unit 72 estimates that the terminal device 14 is within the outside area 214, the extraction unit 72 selects a timing that is not related to the configuration of the frame. In a case where the extraction unit 72 selects the inter-vehicle communication period, the extraction unit 72 supplies information concerning timings of the frame and the sub-frame and the inter-vehicle communication period to the carrier sense unit 74. In a case where the extraction unit 72 selects a timing that is not related to the configuration of the frame, the extraction unit 72 instructs the carrier sense unit 74 to perform carrier sense.

The carrier sense unit 74 accepts the information concerning timings of the frame and the sub-frame and the inter-vehicle communication period from the extraction unit 72. The carrier sense unit 74 determines a transmission timing by starting CSMA/CA during the inter-vehicle communication period. Meanwhile, in a case where the carrier sense unit 74 is instructed by the extraction unit 72 to perform carrier sense that is not related to the configuration of the frame, the carrier sense unit 74 determines a transmission timing by performing CSM/CA without considering the configuration of the frame. The carrier sense unit 74 notifies the modem unit 54 and the RF unit 52 of the determined transmission timing and causes the modem unit 54 and the RF unit 52 to broadcast a packet.

The forwarding determination unit 62 controls transfer of the control information. The forwarding determination unit 62 extracts information to be transferred from the control information. The forwarding determination unit 62 generates information that should be transferred on the basis of the extracted information. Description of this process is omitted. The forwarding determination unit 62 supplies the information that should be transferred, i.e. part of the control information to the generation unit 66.

The acquisition unit 64 includes a GPS receiver, a gyroscope, a vehicle speed sensor, and the like (not illustrated), and acquires the current position, travelling direction, traveling speed, and the like (collectively referred to as "position information" as described above) of the vehicle 12 (not illustrated), i.e., the vehicle 12 in which the terminal device 14 is mounted on the basis of data supplied from the GPS receiver, the gyroscope, the vehicle speed sensor, and the like. The current position is indicated by latitude and longitude. The traveling direction is indicated by an azimuth assuming that a clockwise direction from north which is a reference of traveling direction (0 degree) is a positive angle. The acquisition of the current position, travelling direction, traveling speed, and the like can be performed by using a known art, and description thereof is omitted.

Furthermore, the acquisition unit 64 is connected to a direction indicator of the vehicle 12 in which the present terminal device 14 is mounted and acquires a winker direction indicated by the direction indicator. The winker direction corresponds, for example, to right-winker-ON or left-winker-ON and is also called winker information. The acquisition unit 64 also acquires acceleration of the vehicle 12 in which the present terminal device 14 is mounted. The acceleration may be measured by an acceleration sensor (not illustrated) or may be calculated from a temporal change of traveling speed. The acquisition unit 64 acquires a change of traveling direction after the start of the acquisition of the winker direction, i.e., after right-winker-ON which is a change of traveling direction of the vehicle 12 in which the present terminal device 14 is mounted. Such a change of traveling direction is derived by integrating changes of traveling direction acquired after right-winker-ON. The acquisition unit 64 supplies these pieces of information to the generation unit 66, the support determination unit 68, and the trigger control unit 80.

The generation unit 66 accepts the information from the acquisition unit 64 and accepts part of the control information from the forwarding determination unit 62. The generation unit 66 generates a packet signal including these pieces of information and broadcasts the generated packet signal via the modem unit 54, the RF unit 52, and the antenna 50 at the transmission timing determined by the carrier sense unit 74. This corresponds to inter-vehicle communication.

The support determination unit 68 derives a support that should be provided from among the plural kinds of supports on the basis of the information acquired by the acquisition unit 64 and the information supplied from the extraction unit 72. The plural kinds of supports are, for example, a right-turn collision prevention support, a left-turn collision prevention support, a crossing collision prevention support, and the like. In the following description, the right-turn collision prevention support and the crossing collision prevention support are described.

Figure 5:
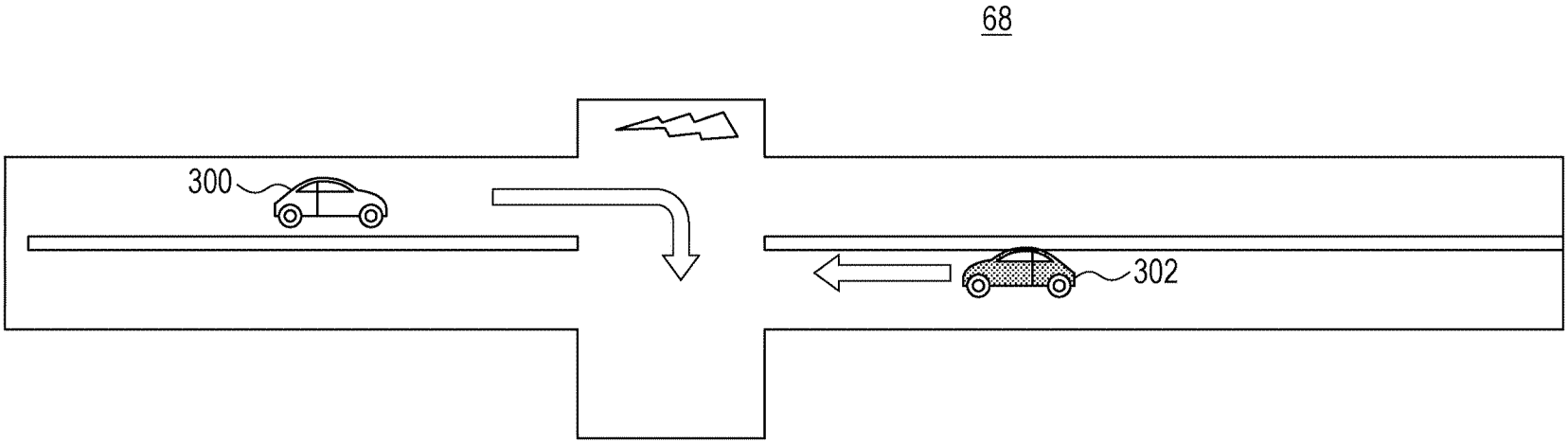
FIG. 5 is a diagram illustrating an outline of a right-turn collision prevention support in a support determination unit in FIG. 4.

First, the right-turn collision prevention support (inter-vehicle communication) is described. This support notifies a driver of the presence of an approaching vehicle (an oncoming vehicle) in a case where an oncoming vehicle is approaching a host vehicle that is about to make a right turn. FIG. 5 illustrates an outline of the right-turn collision prevention support in the support determination unit 68. A host vehicle 300 is waiting for the start of a right turn after traveling from left to right of FIG. 5, and another vehicle 302 is traveling from right to left of FIG. 5. In this situation, the support determination unit 68 acquires, as information from the host vehicle 300, (i) the position, speed, acceleration, and azimuth of the host vehicle 300 from a GPS or an on-board network such as a CAN (Controller Area Network) and (ii) winker information of the host vehicle 300 from the CAN or other means.

Furthermore, the support determination unit 68 acquires, as information from the other vehicle 302, the position, speed, acceleration, azimuth, and winker information of the other vehicle 302. On the basis of these pieces of information, the support determination unit 68 determines occurrence of the right-turn collision prevention support in a case where (i) the speed of the host vehicle 300 is equal to or lower than a predetermined speed, (ii) the right winker of the host vehicle 300 is turned on, (iii) the host vehicle 300 and the other vehicle 302 are in a positional relationship such that the host vehicle 300 and the other vehicle 302 go by each other, and (iv) the host vehicle 300 and the other vehicle 302 encounter each other within a predetermined period of time.

Figure 6:
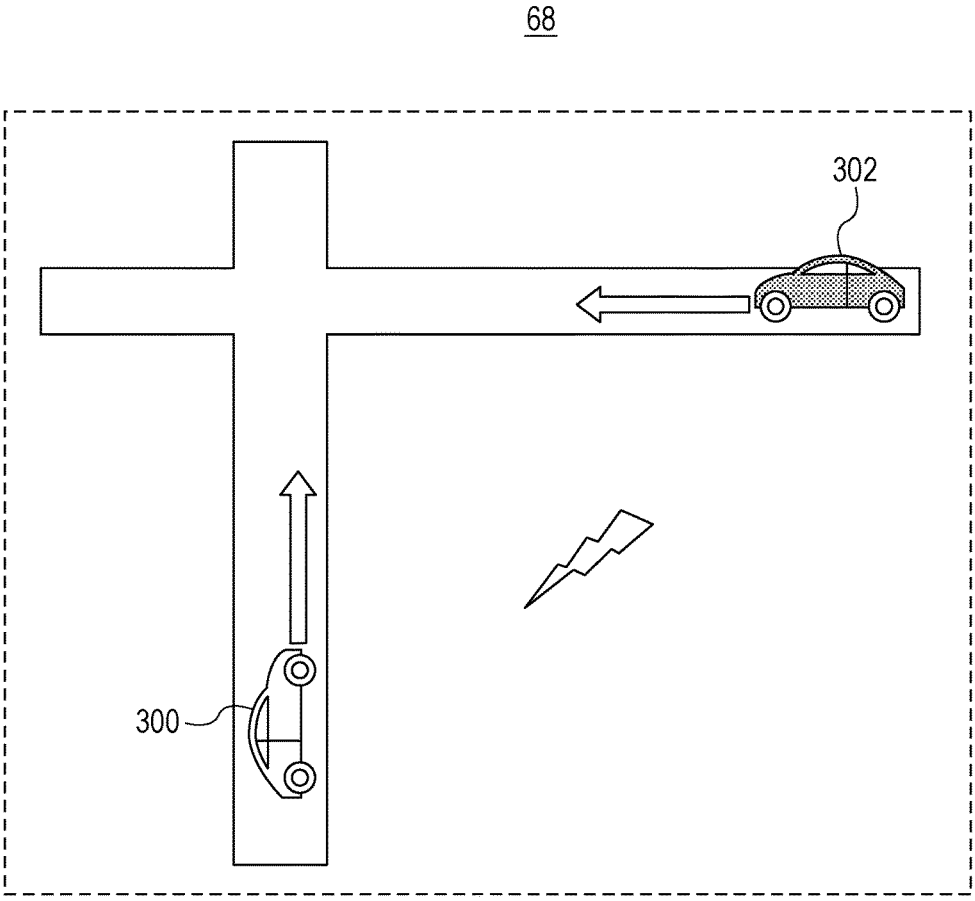
FIG. 6 is a diagram illustrating an outline of a crossing collision prevention support in the support determination unit in FIG. 4.

Next, the crossing collision prevention support (inter-vehicle communication) is described. This support notifies a driver of the presence of an approaching vehicle in a case where another vehicle is approaching so as to cross a host vehicle traveling straight. FIG. 6 illustrates an outline of the crossing collision prevention support in the support determination unit 68. The host vehicle 300 is traveling from bottom to top of FIG. 6, and the other vehicle 302 is traveling from right to left of FIG. 6. In this situation, the support determination unit 68 acquires, as information from the host vehicle 300, the position, speed, acceleration, and azimuth of the host vehicle 300 from a GPS or a CAN.

Furthermore, the support determination unit 68 acquires, as information from the other vehicle 302, the position, speed, acceleration, and azimuth of the other vehicle 302. On the basis of these pieces of information, the support determination unit 68 determines occurrence of the crossing collision prevention support in a case where (i) the host vehicle 300 and the other vehicle 302 are in a positional relationship such that the host vehicle 300 and the other vehicle 302 cross each other and (ii) the host vehicle 300 and the other vehicle 302 encounter each other within a predetermined period of time. Note that a condition that the speed of the host vehicle 300 is equal to or lower than a predetermined speed may be added to the conditions of occurrence of the crossing collision prevention support.

Figure 7:
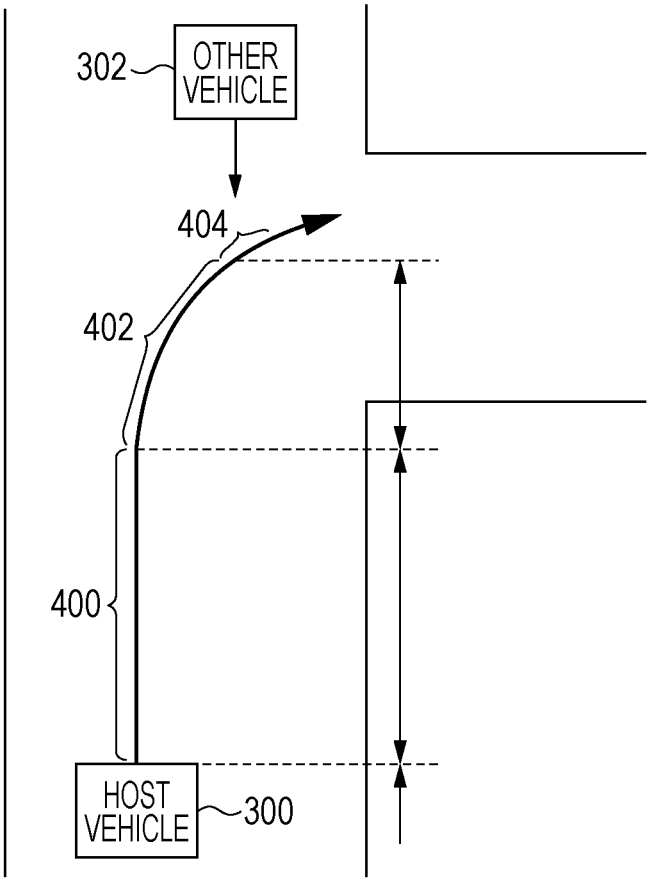
FIG. 7 is a diagram illustrating a right-turn collision prevention support in the support determination unit in FIG. 4.

The present embodiment relates to the right-turn collision prevention support. The right-turn collision prevention support is described in more detail below with reference to FIG. 7. FIG. 7 illustrates the right-turn collision prevention support in the support determination unit 68. The right-turn collision prevention support is executed in a case where the host vehicle 300 that is about to make a right turn detects another oncoming vehicle 302 that is likely to collide with the host vehicle 300, as described above.

An area for warning 400 is an area where a period of time taken for the host vehicle 300 to reach an assumed collision position 404 is longer than 5 sec and is not longer than 8 sec. In the area for warning 400, the host vehicle 300 slows down before making a right turn while turning the right winker on. That is, the host vehicle 300 is in a state of right-winker-ON and low-speed. In the present embodiment, the low speed is 3 m/sec or lower. The other vehicle 302 is traveling from the opposite direction ahead of the host vehicle 300. The support determination unit 68 determines that there is a risk of collision of the other vehicle 302 with the host vehicle 300 in a case where the speed of the other vehicle 302 is equal to or higher than a certain speed, for example, 1.5 m/sec. The condition that the speed of the other vehicle 302 is equal to or higher than a certain speed is set in order to exclude a situation in which the other vehicle is about to stop. In the area for warning 400, the support determination unit 68 lets the driver know the presence of the other vehicle, for example, by emitting a short sound.

An area for alert 402 is an area where a period of time taken for the host vehicle 300 to reach the assumed collision position 404 is not longer than 5 sec. In the area for alert 402, the support determination unit 68 prompts, as an alert, the driver to pay attention, for example, by providing information as an image on a screen and voice.

Figure 8:
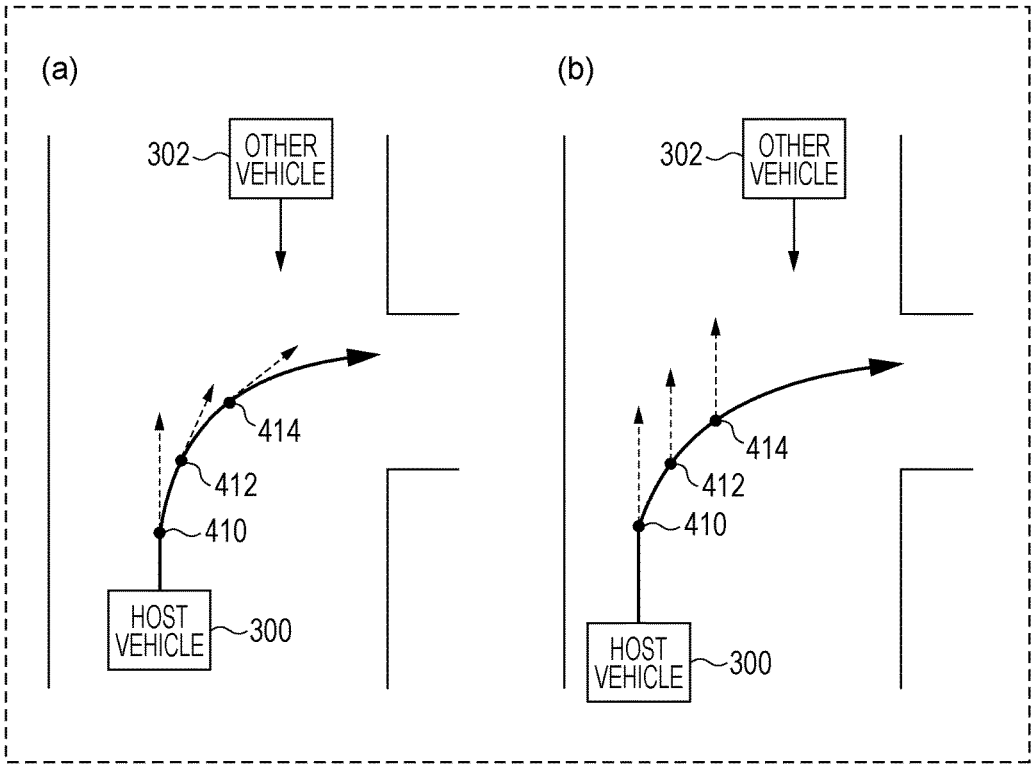
FIG. 8 is a diagram illustrating an outline of a process in a trigger control unit in FIG. 4.

The trigger control unit 80 acquires the winker direction, traveling speed, and traveling direction from the acquisition unit 64. In this example, the winker direction is information of right-winker-ON. The trigger control unit 80 starts acquisition of these pieces of information before acquiring information of right-winker-ON, and causes the traveling direction to be stored in the storage unit 82 in a case where the traveling speed is lower than a threshold value. Such a process is described below with reference to FIG. 8. FIG. 8 illustrates an outline of the process in the trigger control unit 80. FIG. 8(*a*) illustrates a case where a storage process in the trigger control unit 80 is not performed and is a comparative example of the present embodiment. The right winker of the host vehicle 300 is turned on at a first point 410. The arrow at the first point 410 indicates a traveling direction of the host vehicle 300 that is supplied to the support determination unit 68. At the first point 410, the host vehicle 300 and the other vehicle 302 are in a positional relationship such that the host vehicle 300 and the other vehicle 302 go by each other. Therefore, the right-turn collision prevention support is executed in the support determination unit 68.

At a second point 412, the host vehicle 300 starts turning rightward. Therefore, at the second point 412, the traveling direction is inclined rightward as compared with the traveling direction at the first point 410. At a third point 414, the host vehicle 300 further turns rightward. At the third point 414, the traveling direction is further inclined rightward as compared with the traveling direction at the second point 412. Therefore, at the third point 414, the positional relationship between the host vehicle 300 and the other vehicle 302 is regarded as a crossing relationship. Accordingly, the crossing collision prevention support is executed instead of the right-turn collision prevention support in the support determination unit 68. As described above, in a case where the right-turn collision prevention support is changed to the crossing collision prevention support, the contents of an alert provided to the driver also change, and therefore there is a risk of driver's confusion.

FIG. 8(*b*) illustrates a case where a storage process in the trigger control unit 80 is performed. At the first point 410, the right winker of the host vehicle 300 is turned on. As in FIG. 8(*a*), at the first point 410, the host vehicle 300 and the other vehicle 302 are in a positional relationship such that the host vehicle 300 and the other vehicle 302 go by each other. Accordingly, the right-turn collision prevention support is executed in the support determination unit 68. Furthermore, the traveling direction at the first point 410, i.e., the traveling direction indicated by the arrow is stored in the storage unit 82. At the second point 412 and the third point 414, the host vehicle 300 turns rightward. However, the traveling direction stored at the first point 410 is used for the determination as the traveling direction at the second point 412 and the third point 414. Therefore, at the second point 412 and the third point 414, the positional relationship between the host vehicle 300 and the other vehicle 302 is not changed from the positional relationship such that the host vehicle 300 and the other vehicle 302 go by each other. Accordingly, the right-turn collision prevention support is not changed to the crossing collision prevention support in the support determination unit 68, and execution of the right-turn collision prevention support is maintained. The following description returns to FIG. 4.

The trigger control unit 80 updates the traveling direction stored in the storage unit 82 with a changed traveling direction in a case where the traveling direction of the host vehicle 300 has changed to a direction (i.e., a left direction) opposite to the winker direction after the start of acquisition of information of right-winker-ON by the acquisition unit 64. In particular, the trigger control unit 80 updates the traveling direction stored in the storage unit 82 in a case where the traveling direction has changed to a direction opposite to the winker direction with respect to the traveling direction stored in the storage unit 82. This corresponds to storing, in the storage unit 82, a maximum value of the traveling direction that has changed to a direction opposite to the winker direction. Meanwhile, the trigger control unit 80 maintains the traveling direction stored in the storage unit 82 in a case where the traveling direction of the host vehicle 300 has changed to a direction (i.e., a right direction) same as the winker direction after the start of acquisition of information of right-winker-ON by the acquisition unit 64. Such a process is described below with reference to FIG. 9.

Figure 9:
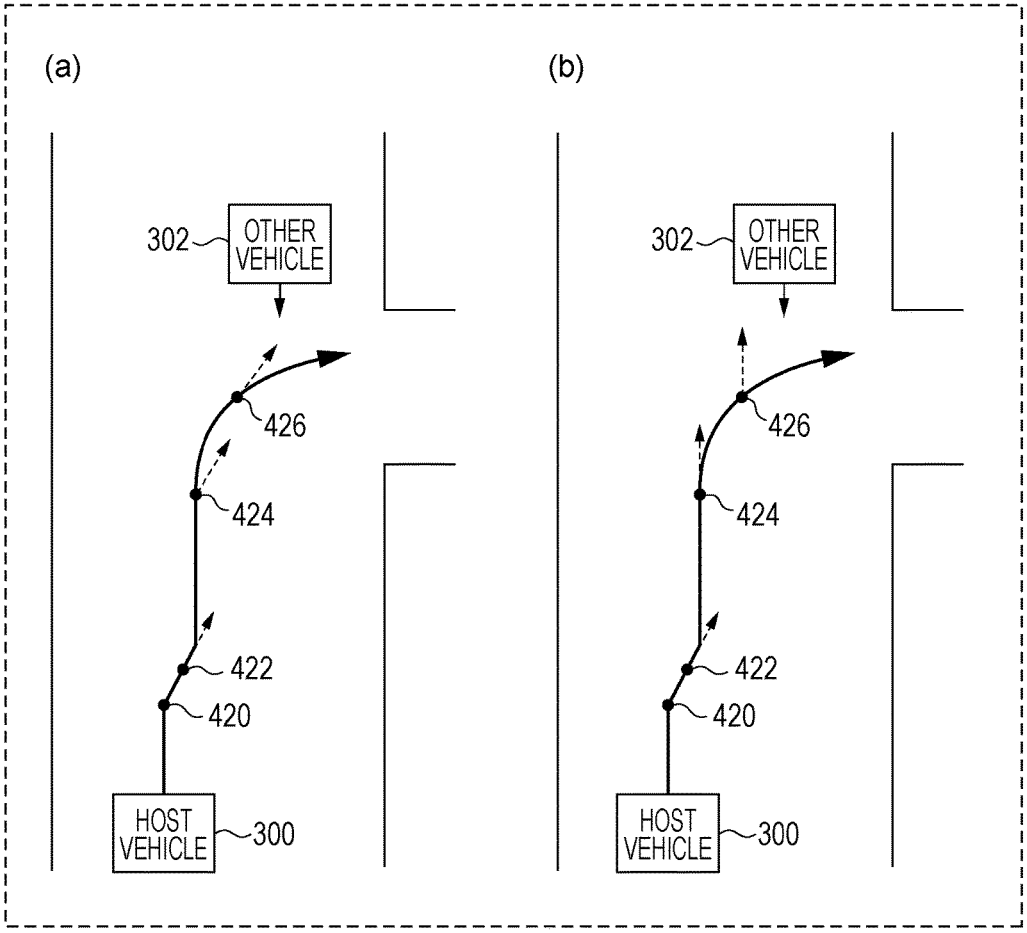
FIG. 9 is a diagram illustrating an outline of another process in the trigger control unit in FIG. 4.

FIG. 9 illustrates an outline of another process in the trigger control unit 80. FIG. 9(*a*) illustrates a process in which a traveling direction is stored only at a timing at which acquisition of information of right-winker-ON is started, as in FIG. 8(*b*). The host vehicle 300 travels on a straight lane until the first point 420 and changes the lane to a right-turn lane from the first point 420 via the second point 422. Furthermore, the host vehicle 300 travels on the right-turn lane until the third point 424 and makes a right turn so as to pass a fourth point 426. It is assumed that the right winker is turned on at the second point 422 which is a point in the middle of a lane change of the host vehicle 300 from the straight lane to the right-turn lane. At the second point 422, the host vehicle 300 has a traveling direction that is inclined rightward from the traveling direction of the road. Therefore, the traveling direction that is inclined rightward from the traveling direction of the road is stored in the storage unit 82. This traveling direction is maintained also at the third point 424 and the fourth point 426. As a result, there is a possibility that the positional relationship between the host vehicle 300 and the other vehicle 302 is not regarded as a positional relationship such that the host vehicle 300 and the other vehicle 302 go by each other and the right-turn collision prevention support is not executed. That is, there is a possibility that the positional relationship between the host vehicle 300 and the other vehicle 302 is regarded as a positional relationship such that the host vehicle 300 and the other vehicle 302 cross each other and the right-turn collision prevention support is changed to the crossing collision prevention support.

FIG. 9(*b*) illustrates a process in which the stored traveling direction is updated. As in FIG. 9(*a*), the right winker is turned on at the second point 422 which is a point in the middle of a lane change of the host vehicle 300 from the straight lane to the right-turn lane. Therefore, the traveling direction at the second point 422 that is inclined rightward from the traveling direction of the road is stored in the storage unit 82. Subsequently, when the host vehicle 300 travels on the right-turn lane, the traveling direction is directed toward the traveling direction of the road. That is, the traveling direction is changed to the left from the stored traveling direction. In accordance with this change, the trigger control unit 80 updates the stored traveling direction with the changed traveling direction. Therefore, at the third point 424, the traveling direction that is directed toward the traveling direction of the road is stored. At the fourth point 426, the traveling direction of the host vehicle 300 changes to the right which is the same direction as the winker direction indicating right-winker-ON. Therefore, the trigger control unit 80 maintains the stored traveling direction without storing the changed traveling direction. That is, the traveling direction that is directed toward the traveling direction of the road is stored. In this way, the stored traveling direction is updated, and the traveling direction is not changed even in a case where the host vehicle 300 starts turning rightward to make a right turn, and therefore execution of the right-turn collision prevention support is continued. The following description returns to FIG. 4.

Furthermore, the trigger control unit 80 determines that the host vehicle 300 has started right-turn crossing in a case where the acceleration becomes higher than a threshold value and where the acquired change of traveling direction becomes larger than a threshold value after the start of acquisition of the information of right-winker-ON by the acquisition unit 64, and clears the acquisition of the information of right-winker-ON even if the actual right winker is on. Note that the threshold value compared with the acceleration and the threshold value compared with the change of traveling direction may be different values. Clearing the acquisition of the information of right-winker-ON corresponds to canceling the right-turn collision prevention support in the support determination unit 68. The trigger control unit 80 notifies the support determination unit 68 of the clearance. Such a process is described below with reference to FIG. 10.

Figure 10:
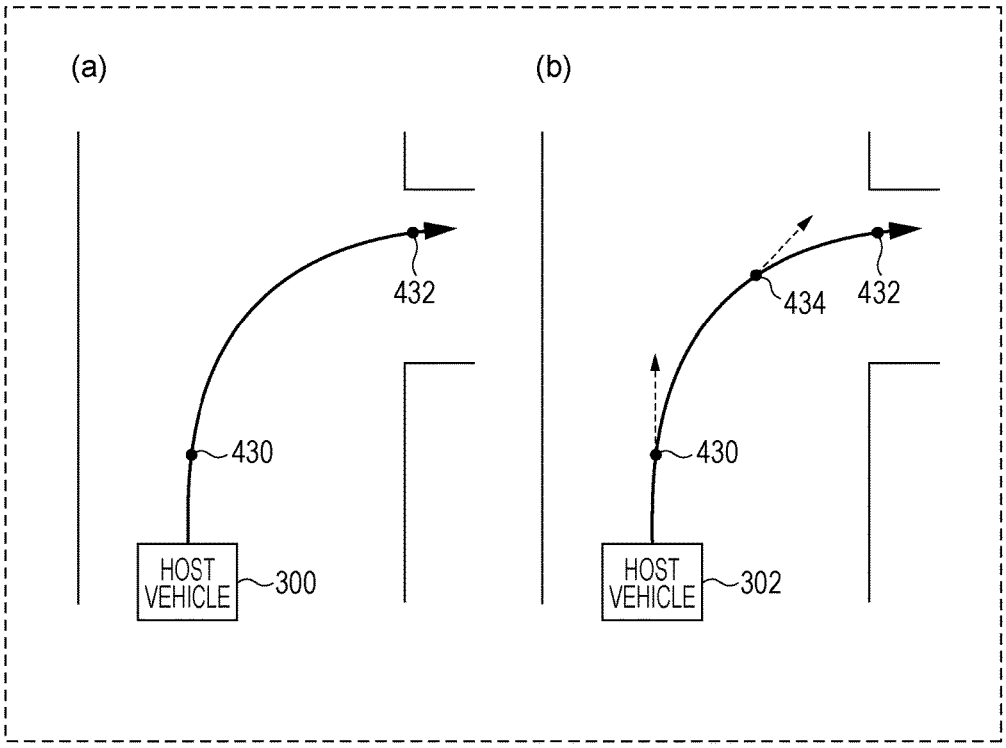
FIG. 10 is a diagram illustrating an outline of still another process in the trigger control unit in FIG. 4.

FIG. 10 illustrates an outline of still another process in the trigger control unit 80. FIG. 10(*a*), which is a comparative example of the present embodiment, illustrates a case where acquisition of information of right-winker-ON is cleared when the actual right winker is turned off. The right winker of the host vehicle 300 is turned on at the first point 430 and is turned off at the second point 432. In this case, in the host vehicle 300, execution of the right-turn collision prevention support is continued until the end of crossing of the road. The right-turn collision prevention support should be executed in order to prompt the driver to pay attention until the start of an actual right turn, and it is desirable that the host vehicle 300 promptly cross the road after the start of the actual right turn. It is therefore desirable that acquisition of information of right-winker-ON be cleared before the actual right winker is turned off.

FIG. 10(*b*) illustrates a case where acquisition of information of right-winker-ON is cleared in accordance with a standard of the present embodiment. The third point 434 is a point before the second point 432 (a point on the first point 430 side). The arrow at the first point 430 and the arrow at the third point 434 indicate a change of traveling direction. At the third point 434, the change of traveling direction of the host vehicle 300 becomes larger than the threshold value and the acceleration becomes higher than the threshold value, and therefore it is determined that the host vehicle 300 has started right-turn crossing. Accordingly, even in a case where the actual right winker is on, the trigger control unit 80 clears acquisition of information of right-winker-ON. As a result, the right-turn collision prevention support is finished at the third point 434. The following description returns to FIG. 4.

The storage unit 82 stores therein a traveling direction and clears a stored traveling direction under control of the trigger control unit 80. The storage unit 82 supplies a stored traveling direction to the support determination unit 68. The support determination unit 68 uses the traveling direction supplied from the storage unit 82 to determine whether or not the conditions of the right-turn collision prevention support are met. The display unit 70 displays, on a monitor (not illustrated), a message concerning the right-turn collision prevention support such as "be careful of oncoming vehicle". The notification unit 70 may display a map image of a car navigation system. The notification unit 70 may notify the driver of the presence of the other vehicle 302 by using voice or the like in addition to information displayed by the display unit 70.

Figure 11:
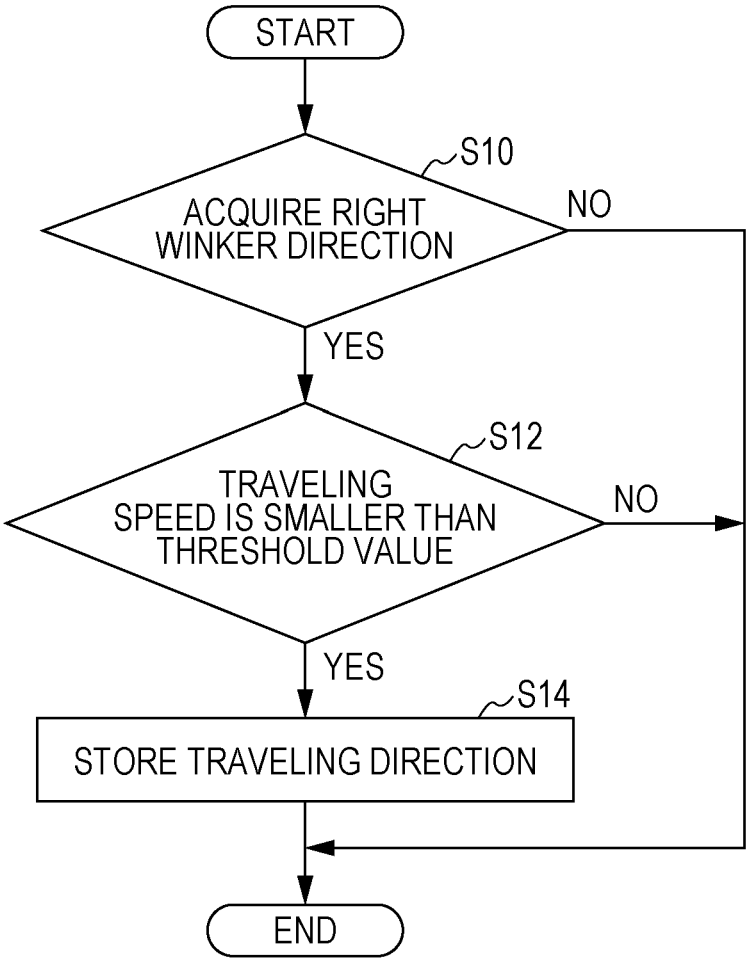
FIG. 11 is a flow chart illustrating a traveling direction storage procedure of the trigger control unit in FIG. 4.

An operation of the communication system 100 configured as above is described below. FIG. 11 is a flow chart illustrating a traveling direction storage procedure of the trigger control unit 80 in the right-turn collision prevention support. In a case where a right winker direction is acquired (Yes in S10) and where a traveling speed is lower than a threshold value (Yes in S12), the trigger control unit 80 causes the traveling direction of the vehicle 12 to be stored in the storage unit 82 (S14). Meanwhile, in a case where a right winker direction is not acquired (No in S10) or in a case where the traveling speed is not lower than the threshold value (No in S12), the process is finished.

Figure 12:
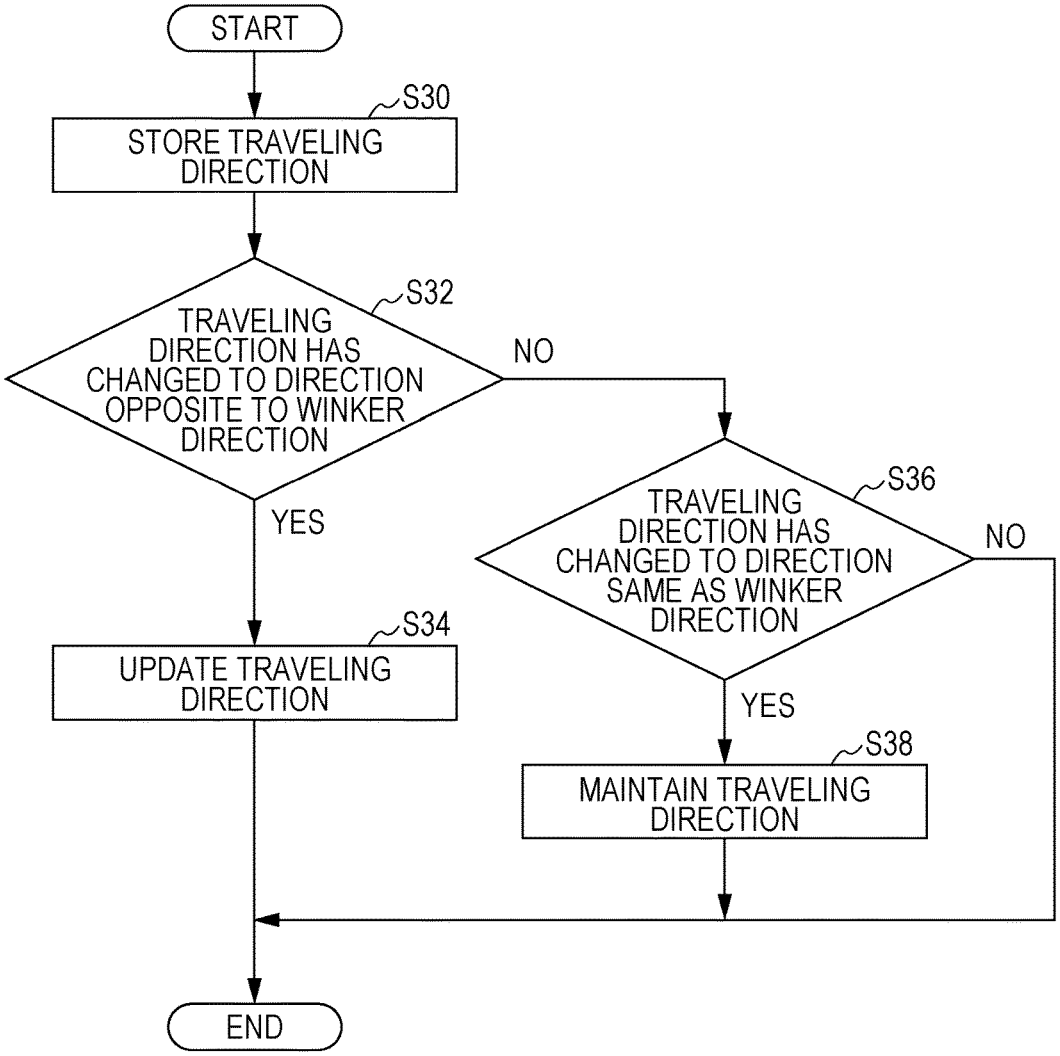
FIG. 12 is a flow chart illustrating a traveling direction updating procedure of the trigger control unit in FIG. 4.

FIG. 12 is a flow chart illustrating a traveling direction updating procedure of the trigger control unit 80. This corresponds to a process that follows the process in FIG. 11. The storage unit 82 stores therein the traveling direction of the vehicle 12 (S30). In a case where the traveling direction has changed to a direction opposite to the winker direction (Yes in S32), the trigger control unit 80 updates the traveling direction stored in the storage unit 82 (S34). In a case where the traveling direction is not changed to a direction opposite to the winker direction (No in S32) and where the traveling direction has been changed to a direction same as the winker direction (Yes in S36), the trigger control unit 80 maintains the traveling direction stored in the storage unit 82 (S38). In a case where the traveling direction is not changed to the direction same as the winker direction (No in S36), the process is finished.

Figure 13:
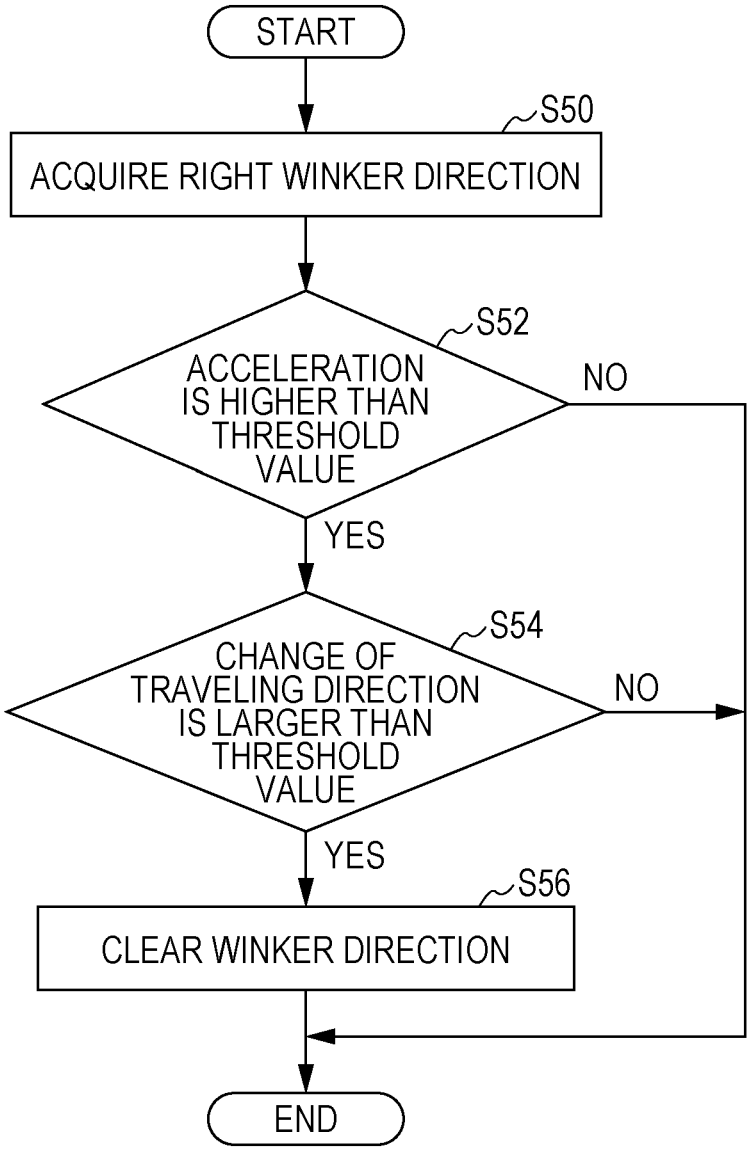
FIG. 13 is a flow chart illustrating a winker direction clearing procedure of the trigger control unit in FIG. 4.

FIG. 13 is a flow chart illustrating a winker direction clearing procedure of the trigger control unit 80. The trigger control unit 80 acquires a right winker direction (S50). In a case where the acceleration becomes higher than a threshold value (Yes in S52) and where the change of traveling direction becomes larger than a threshold value (Yes in S54), the trigger control unit 80 dears the winker direction (S56). In a case where the acceleration is not higher than the threshold value (No in S52) or in a case where the change of traveling direction is not larger than the threshold value (No in S54), the process is finished.

According to the embodiment of the present disclosure, the stored traveling direction is updated in a case where the traveling direction has changed to the left after the start of acquisition of information of right-winker-ON, and the stored traveling direction is maintained in a case where the traveling direction has changed to the right after the start of acquisition of information of right-winker-ON. It is therefore possible to acquire an accurate traveling direction of the road irrespective of a timing at which the start of a right-turn action is determined. Since the accurate traveling direction of the road can be acquired, it is possible to improve the accuracy of estimation of a traveling direction before the right turn. Since the accuracy of estimation of a traveling direction before the right turn is improved, it is possible to suppress occurrence of a situation in which the right-turn collision prevention support is changed to the crossing collision prevention support. Since occurrence of a situation in which the right-turn collision prevention support is changed to the crossing collision prevention support is suppressed, it is possible to stably provide the right-turn collision prevention support. Furthermore, since the acquired traveling direction is stored in a case where the traveling speed is lower than a threshold value, the start of a right turn and a lane change can be distinguished from each other. Since the start of a right turn and a lane change can be distinguished from each other, it is possible to improve the accuracy of estimation of a start timing of a right-turn action.

Since acquisition of information of right-winker-ON is cleared in a case where the acceleration becomes higher than a threshold value, an end timing of a right-turn action can be determined at an early timing. Since an end timing of a right-turn action can be determined at an early timing, it is possible to suppress occurrence of a situation in which the right-turn collision prevention support is continued even after the end of the right turn. Furthermore, since acquisition of information of right-winker-ON is cleared by also considering a case where the acquired change of traveling direction becomes larger than a threshold value, the accuracy of clearance can be improved. Since an accurate traveling direction of the road can be acquired in the right-turn collision prevention support that is executed by inter-vehicle communication, the present embodiment is also effective even in a situation in which no base station device is disposed.

The present disclosure has been described above on the basis of the embodiment. This embodiment is an illustrative example, and it can be understood by a person skilled in the art that a combination of the constituent elements or a combination of processes can be modified in various ways and that such modifications are encompassed within the scope of the present disclosure.

In the present embodiment, a right turn in the case of left-hand traffic is targeted. However, the present embodiment is not limited to this. A left turn in the case of right-hand traffic may be targeted. In this case, the right-left relationship in the trigger control unit 80 and the support determination unit 68 is reversed. According to the present modification, the application scope of the present embodiment can be widened.

In the present embodiment, a right turn is targeted. However, the present embodiment is not limited to this. A left turn may be targeted. In this case, the right-left relationship in the trigger control unit 80 and the support determination unit 68 is reversed. According to the present modification, the application scope of the present embodiment can be widened.

In the present embodiment, in a case where acquisition of information of right-winker-ON is started from a state where the information of right-winker-ON is not acquired and where the traveling speed is lower than a threshold value, the trigger control unit 80 causes the traveling direction to be stored in the storage unit 82. However, the present embodiment is not limited to this. For example, the trigger control unit 80 may cause the traveling direction to be stored in the storage unit 82 in a case where acquisition of information of right-winker-ON is started from a state where the information of right-winker-ON is not acquired irrespective of the traveling speed. According to the present modification, the process can be simplified.

In the present embodiment, the trigger control unit 80 clears acquisition of information of right-winker-ON by the acquisition unit 64 in a case where the acceleration becomes higher than a threshold value and where the acquired change of traveling direction becomes larger than a threshold value after the start of acquisition of information of right-winker-ON by the acquisition unit 64. However, the present embodiment is not limited to this. For example, the trigger control unit 80 may clear acquisition of information of right-winker-ON in a case where the acceleration acquired by the acquisition unit 64 becomes higher than a threshold value irrespective of the change of traveling direction. According to the present modification, the process can be simplified.

In the present embodiment, a situation in which a host vehicle makes a right turn at an intersection is assumed.

However, the present embodiment is not limited to this. For example, a situation in which a host vehicle crosses a road on which the host vehicle is traveling by turning rightward so as to enter a parking area or the like located on the right of the road may be assumed. According to the present modification, the application scope of the present embodiment can be widened.

One aspect of the present disclosure is summarized as follows.

(1) A terminal device according to one aspect of the present disclosure is a terminal device that is mountable in a vehicle, including: an acquirer operative to acquire, from the vehicle, i) traveling direction information indicating traveling directions of the vehicle in accordance with movement of the vehicle and ii) winker direction information indicating a winker direction indicated by a direction indicator of the vehicle; a storage; and a controller operative to: store in the storage the traveling direction information indicating a first traveling direction of the traveling directions, the first traveling direction being acquired in a case where the acquirer has acquired the winker direction information; update the traveling direction information indicating the first traveling direction with the traveling direction information indicating a second traveling direction, the second traveling direction being acquired after the acquirer has acquired the winker direction information, in a case where the second traveling direction indicates a direction opposite to the winker direction indicated by the winker direction information; and maintain in the storage the traveling direction information indicating the first traveling direction in a case where the second traveling direction indicates a direction same as the winker direction indicated by the winker direction information.

According to the aspect, the stored traveling direction is updated in a case where the traveling direction has changed to a direction opposite to the winker direction after the start of acquisition of the winker direction, and the stored traveling direction is maintained in a case where the traveling direction has changed to a direction same as the winker direction after the start of acquisition of the winker direction. It is therefore possible to accurately maintain a traveling direction before the start of a right-turn action irrespective of a timing at which the start of the right-turn action is determined.

(2) In the aspect, the terminal device may be arranged such that the traveling directions are indicated by a clockwise azimuth assuming that north is a reference of traveling direction.

(3) In the aspect, the terminal device may be arranged such that the winker direction is a right direction or a left direction with respect to the first traveling direction, the right direction including a direction in a range from 0 degree to 180 degrees in a clockwise direction assuming that the traveling direction is a reference of traveling direction, and the left direction including a direction in a range from 0 degree to 180 degrees in a counterclockwise direction assuming that the traveling direction is a reference of traveling direction.

(4) In the aspect, the terminal device may be arranged such that the controller updates the traveling direction information indicating the first traveling direction with the traveling direction information indicating a second traveling direction, in a case where the winker direction indicates right and where the second traveling direction indicates a left direction with respect to the first traveling direction; and the controller updates the traveling direction information indicating the first traveling direction with the traveling direction information indicating a second traveling direction, in a case where the winker direction indicates left and where the second traveling direction indicates to a right direction with respect to the first traveling direction.

In this case, in a case where the traveling direction has changed to a direction opposite to the winker direction, a state where the direction has changed the most is stored. It is therefore possible to more accurately maintain a traveling direction before the start of a right-turn action or a left-turn action.

(5) In the aspect, the terminal device may be arranged such that the left direction includes a direction in a range from 0 degree to 90 degrees in a counterclockwise direction assuming that the first traveling direction is a reference of traveling direction; and the right direction includes a direction in a range from 0 degree to 90 degrees in a clockwise direction assuming that the first traveling direction is a reference of traveling direction.

(6) The terminal device may be arranged such that the the acquirer further acquires traveling speed information indicating a traveling speed of the vehicle; and the controller stores in the storage the traveling direction information indicating the first traveling direction, in a case i) where the acquirer has acquired the winker direction and ii) where the acquired traveling speed is lower than a first threshold value.

In this case, the acquired traveling direction is stored in a case where the traveling speed is lower than a threshold value. It is therefore possible to improve the accuracy of estimation of a timing of the start of a right-turn action.

(7) In the aspect, the terminal device may be arranged such that the acquirer further acquires acceleration information indicating acceleration of the vehicle; and the controller stores in the storage status information indicating that the acquirer has acquired the winker direction information, and the controller clears the status information from the storage in a case where the acceleration indicated by the acceleration information becomes higher than a second threshold value after the acquirer has acquired the winker direction information.

In this case, acquisition of the winker direction is cleared in a case where the acceleration becomes higher than a threshold value. It is therefore possible to determine a timing of the end of a right-turn action at an early timing.

(8) In the aspect, the terminal device may be arranged such that the acquirer further acquires direction angle information indicating a change of direction angle between the first traveling direction and the second traveling direction; and the controller clears the status information from the storage in a case i) where the acceleration indicated by the acceleration information becomes higher than the second threshold value and ii) where the change of the direction angle becomes larger than a third threshold value.

In this case, acquisition of the winker direction is cleared by also considering a case where the acquired change of traveling direction becomes larger than a threshold value. It is therefore possible to improve the accuracy of determination of clearance of acquisition of the winker direction.

What is claimed is:

1. A terminal device that is mountable in a vehicle, comprising:

a receiver, coupled to a vehicle, configured to receive i) traveling direction information indicating traveling directions of the vehicle in accordance with movement of the vehicle and ii) turn signal information associated with a direction indicator of the vehicle to be activated by a driver at a time to show intent to turn a direction or change lanes;

storage; and a processor programmed to execute a collision prevention process relative to an oncoming vehicle when the vehicle turns a direction, the collision prevention process including controlling communication with the another vehicle to receive information of the oncoming vehicle, and notifying a driver of a presence of the oncoming vehicle depending on positional relationship between the vehicle and the oncoming vehicle, wherein the collision prevention process further includes, in order to determine a direction of a road on which the vehicle travels:

storing in the storage the traveling direction information indicating a first traveling direction of the traveling directions, the first traveling direction being acquired when the receiver receives the turn signal information from the vehicle;

updating the traveling direction information indicating the first traveling direction with the traveling direction information indicating a second traveling direction, the second traveling direction being acquired after the receiver receives the turn signal information, in a case where the second traveling direction indicates a direction opposite to a direction indicated by the turn signal direction information; and maintaining in the storage the traveling direction information indicating the first traveling direction in a case where the second traveling direction indicates a direction same as the turn signal direction information.

2. The terminal device according to claim 1, wherein the traveling directions are indicated by a clockwise azimuth assuming that north is a reference of traveling direction.

3. The terminal device according to claim 1, wherein the direction indicated by the direction indicator is a right direction or a left direction with respect to the first traveling direction, the right direction including a direction in a range from 0 degree to 180 degrees in a clockwise direction assuming that the traveling direction is a reference of traveling direction, and the left direction including a direction in a range from 0 degree to 180 degrees in a counterclockwise direction assuming that the traveling direction is a reference of traveling direction.

4. The terminal device according to claim 1, wherein the controller updates the traveling direction information indicating the first traveling direction with the traveling direction information indicating a second traveling direction, in a case where the direction shown by the direction indicator indicates right and where the second traveling direction indicates a left direction with respect to the first traveling direction; and the controller updates the traveling direction information indicating the first traveling direction with the traveling direction information indicating a second traveling direction, in a case where the direction shown by the direction indicator indicates left and where the second traveling direction indicates to a right direction with respect to the first traveling direction.

5. The terminal device according to claim 4, wherein the left direction includes a direction in a range from 0 degree to 90 degrees in a counterclockwise direction assuming that the first traveling direction is a reference of traveling direction; and the right direction includes a direction in a range from 0 degree to 90 degrees in a clockwise direction assuming that the first traveling direction is a reference of traveling direction.

6. The terminal device according to claim 1, wherein the receiver further acquires traveling speed information indicating a traveling speed of the vehicle; and the controller stores in the storage the traveling direction indicating the first traveling direction, in a case i) where the receiver receives the turn signal information and ii) where the acquired traveling speed is lower than a first threshold value.

7. The terminal device according to claim 1, wherein the receiver further acquires acceleration information indicating acceleration of the vehicle; and the controller stores in the storage status information indicating that the receiver receives the turn signal direction information, and the controller clears the status information from the storage in a case where the acceleration indicated by the acceleration information becomes higher than a second threshold value after the receiver receives the turn signal direction information.

8. The terminal device according to claim 7, wherein the receiver further acquires direction angle information indicating a change of direction angle between the first traveling direction and the second traveling direction; and the controller clears the status information from the storage in a case i) where the acceleration indicated by the acceleration information becomes higher than the second threshold value and ii) where the change of the direction angle becomes larger than a third threshold value.

* * * * *